United States Patent [19]

Komaki

[11] Patent Number: 4,712,599

[45] Date of Patent: Dec. 15, 1987

[54] SHUTTER

[75] Inventor: Toshiro Komaki, Tokyo, Japan

[73] Assignee: Tachikawa Corporation, Tokyo, Japan

[21] Appl. No.: 746,830

[22] Filed: Jun. 19, 1985

[30] Foreign Application Priority Data

Mar. 7, 1984 [JP] Japan ..... 59-44277[U]
Jul. 2, 1984 [JP] Japan ..... 59-99729[U]

[51] Int. Cl.[4] ..... A47G 5/02; E06B 9/202
[52] U.S. Cl. ..... 160/133; 160/321; 160/176 R
[58] Field of Search ..... 160/133, 309, 321, 319, 160/313, 176 R, 177

[56] References Cited

U.S. PATENT DOCUMENTS

| | | | |
|---|---|---|---|
| 2,564,197 | 8/1951 | Dobkin | 160/133 |
| 2,872,977 | 2/1959 | Pagliaccetti et al. | 160/133 X |
| 3,102,580 | 9/1963 | Greegor | 160/133 |
| 3,842,892 | 10/1974 | Stieler | 160/133 |
| 4,493,356 | 1/1985 | Hermann et al. | 160/133 |
| 4,503,899 | 3/1985 | Forquer | 160/133 |

*Primary Examiner*—Ramon S. Britts
*Assistant Examiner*—Karen J. Chotkowski
*Attorney, Agent, or Firm*—Jordan and Hamburg

[57] ABSTRACT

A shutter is provided which is moved up and down by the use of the urging force of a take-up spring for turning a take-up shaft that winds up a number of slats and the weight of the slats. These slats are mutually coupled vertically expandably and a number of slits are formed in expandable portions of individual slats. The shutter includes a slit open/close means for expanding and contracting the slats to open/close the slits.

10 Claims, 14 Drawing Figures

SHUTTER

BACKGROUND OF THE INVENTION

1. Field of the Invention

This invention relates to a shutter which is installed in a doorway or window.

2. Description of the Prior Art

As shutter elevating means two types are well known; in one type slats are wound up by the use of the urging force of a spring accommodated inside a take-up shaft and in the other type the slats are wound up by turning the take-up shaft manually or by the use of a motor. According to the shutter of the type in that it is elevated by turning the take-up shaft manually or by the motor, the slats are mutually coupled vertically expandably, slits are formed which are exposed only when the slats are in the expanded state, and lighting and draft are effected if the slits are exposed even when the slats have been unwound.

On the contrary, in the shutter of the type in that it is elevated by the use of the urging force of the spring, because it is difficult to finely control rotation of the take-up shaft, the slats are coupled without an expandable function and no slit is formed. Accordingly, this type does not permit lighting and draft in the unwound state of the shutter.

SUMMARY OF THE INVENTION

It is an object of the present invention to provide a shutter which permits lighting and draft even in the unwound state of slats.

It is another object of the present invention to provide a shutter which is reduced in number of parts and easily assemblable with its slit open/close means being simplified in structure.

In order to achieve the foregoing objects, the present invention provided a shutter of the type in that its elevating action is performed by the use of the urging force of a take-up spring for turning a take-up shaft that winds up a number of slats and the weight of the slats, which is characterized in that a number of slats are mutually coupled vertically expandably, a number of slits are formed in expandable portions of individual slats, and a slit open/close means is provided for expanding and contracting the slats to open/close the slits.

Other objects of the present invention will become apparent through understanding of the following detailed description of the preferred embodiments and be defined in the following claims. And its advantages not mentioned herein will become clear to those skilled in the art when putting the invention into practice.

BRIEF DESCRIPTION OF THE INVENTION

DETAILED DESCRIPTION OF THE PREFERRED EMBODIMENTS

Figure 1:
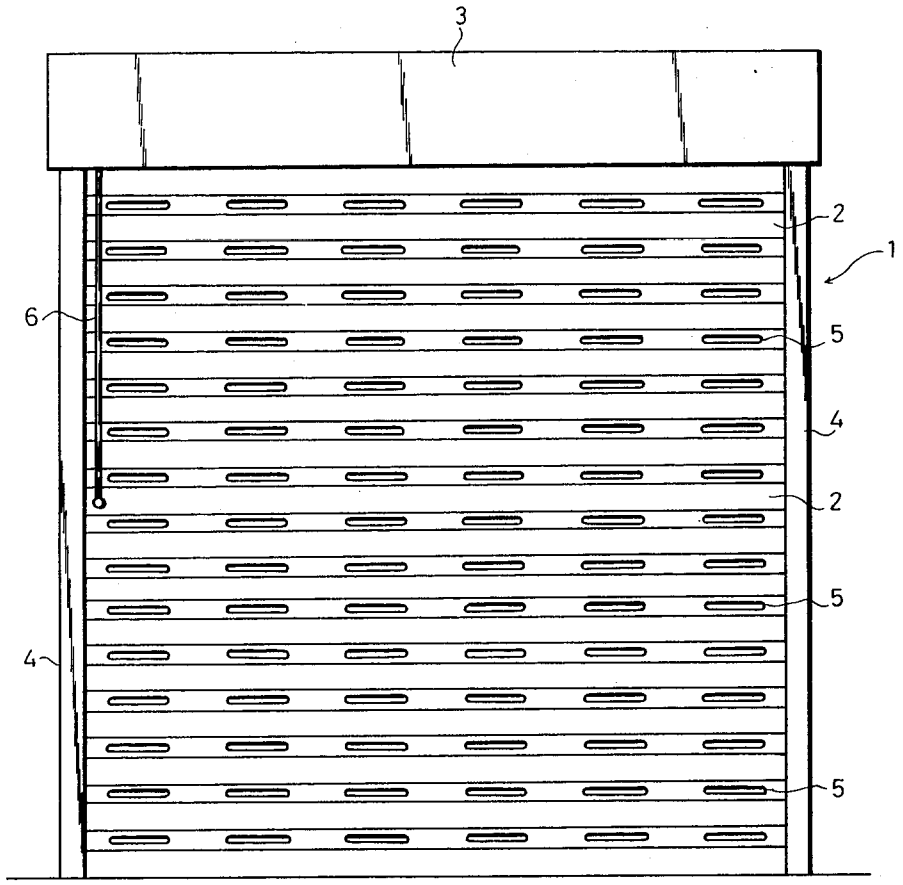
FIG. 1 is a front view showing the full-open state of slits of a shutter.

Describing now a first embodiment of a shutter 1 according to the present invention with reference to FIGS. 1 through 6, a number of slats 2 coupled vertically in a multistage fashion are suspended from and supported by a take-up shaft 10 (hereinafter described) supported rotatably inside a bracket 3. Each slat 2 is moved up and down while its ends are guided by guide rails 4. An elevating means to perform the above action is realized by a take-up spring S accommodated inside the take-up shaft 10. Similarly to an ordinary shutter, at the time of opening the shutter 1 according to the present invention, a user lifts the slats a little, whereby the slats are automatically wound up by the urging force of the spring up to the full-open state. At the time of closing the shutter, the user pulls down the slats 2 a little, whereby the slats move down automatically by their own weight.

The slats 2 are mutually coupled vertically expandable, and each of their coupling sections is formed with a number of slits 5 distributed in the longitudinal direction of the slat. When each slat 2 has become the expanded state, the slits 5 in each coupling section are exposed. Further, as a downward control force is applied to the slats 2 in the open state of the shutter 1, the slats 2 move down while using their own weight and stop when they become the expanded state shown in FIG. 1, i.e. when the slits 5 become the exposed state.

As shown in FIG. 1, a control cord 6 is hung down on one side of the shutter 1, which functions such as to close the slits 5 under the condition that the shutter 1 is in the closed state with the slits 5 being exposed. That is, by operating the control cord, a slit open/close means (hereinafter described) provided inside the bracket 3 causes each slat 2 to move down further, so that the slats 2 become the state shown in FIG. 2 wherein the slats 2 have contracted successively one after another from the lowest one and correspondingly, slits 5 have been closed.

Figure 3:
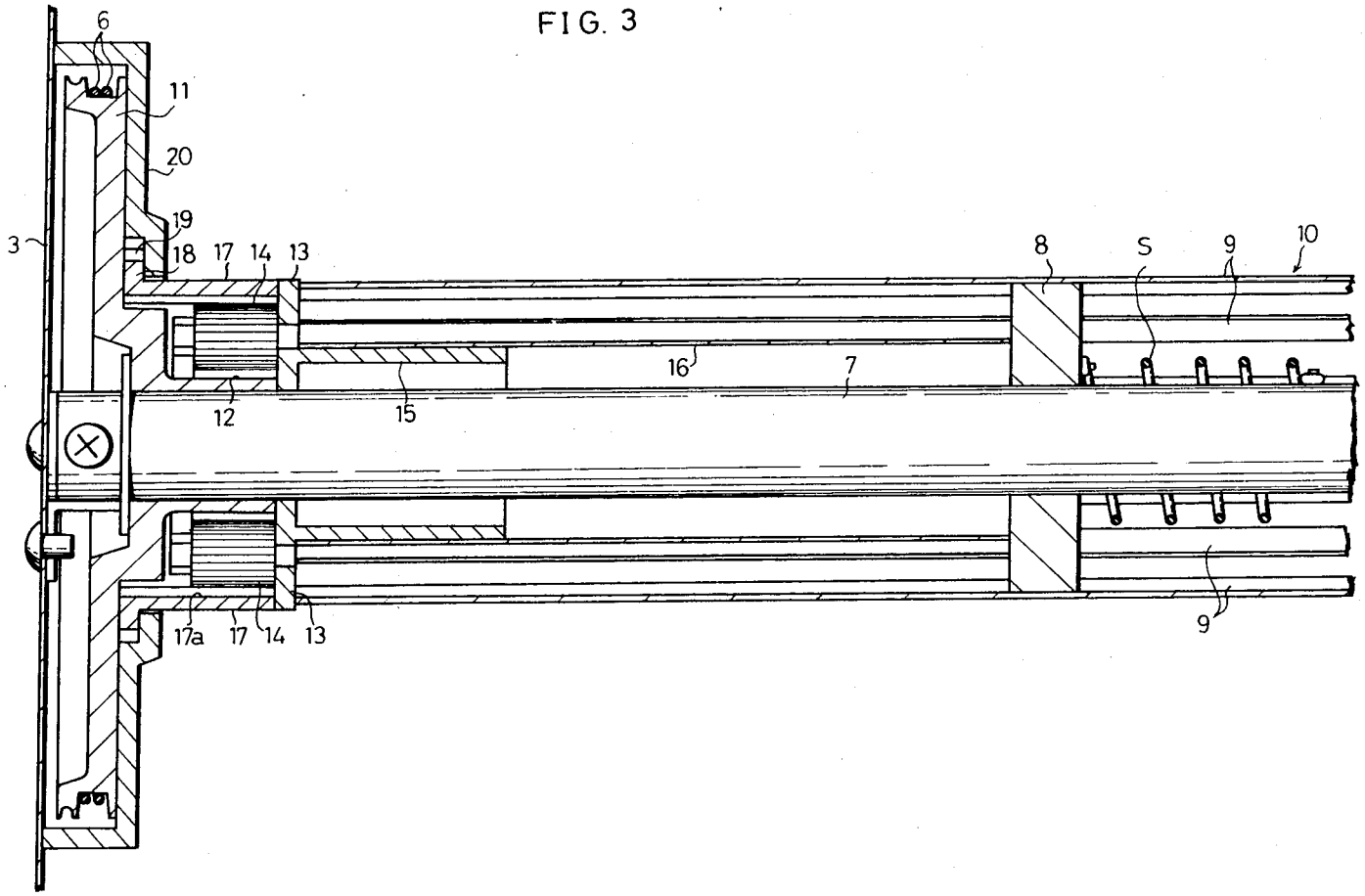
FIG. 3 is a cross sectional view of a slit open/close means of a first embodiment.
Figure 4:
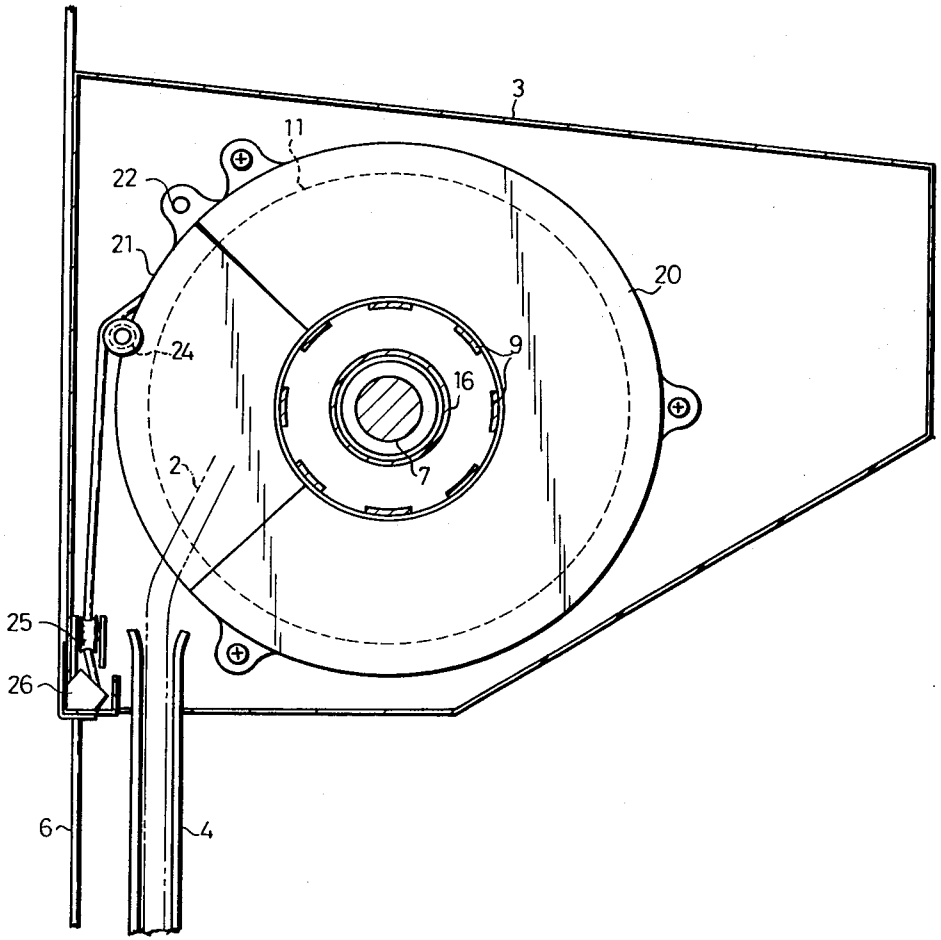
FIG. 4 is a side view of the above.
Figure 5:
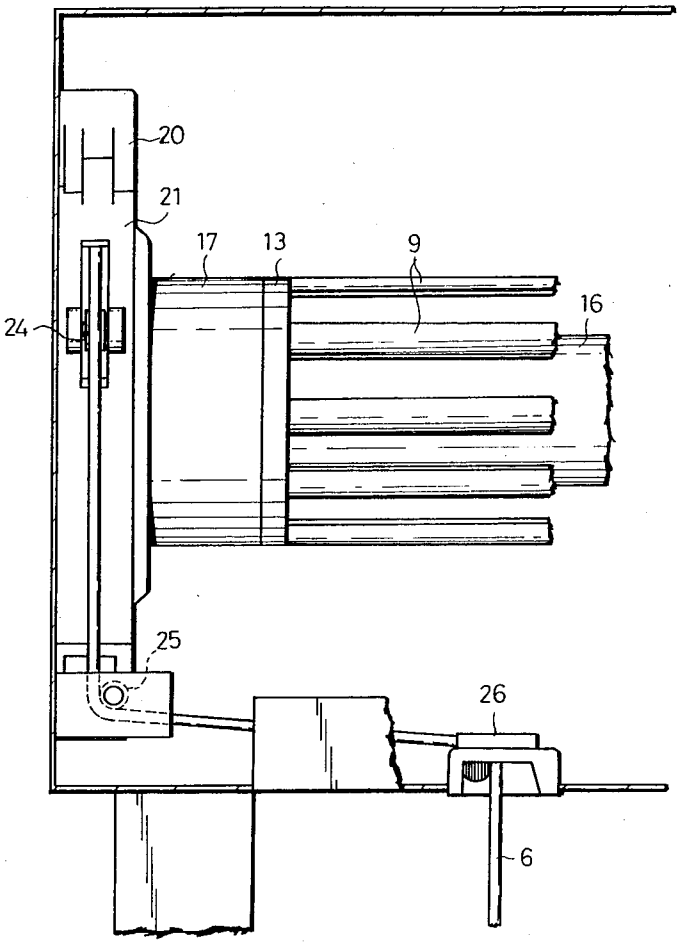
FIG. 5 is a front view of the above.

Describing now the slit open/close means, in FIG. 3, a core shaft 7 is fixed to both sides of the bracket 3 and prevented from turning, a pair of take-up pulleys 8 are supported rotatably by the core shaft in the vicinity of either end thereof, the peripheries of these take-up pulleys 8 are coupled by plural coupling boards 9 thereby forming the take-up shaft 10.

Inside the take-up shaft 10 the take-up spring S functioning as the elevating means of the shutter is provided. One end of the take-up spring S is secured to the core shaft 7, the other end is secured to one of the take-up pulleys 8, and working energy is stored in the spring S by relative rotation between the core shaft 7 and the take-up pulley 8 when the take-up shaft 10 is rotated in the direction of causing the slats to move down. The urging force of the take-up spring S acting on the take-up shaft 10 in the direction of winding up the slats is made to agree with the action of the weight of the slats 2 hung down from the take-up shaft 10 when the shutter 1 is closed with the slits 5 of each slat 2 exposed as shown in FIG. 1, and this balanced condition is preserved.

On one end of the core shaft 7 a driving pulley 11 is supported rotatably via a bearing, around which the control cord 6 is coiled. A center portion of the driving pulley 11 projects inward the bracket 3 and formed on the periphery with teeth defining a sun gear 12. Around the sun gear 12 planet gears 14 supported rotatably by a planet carrier 13 are disposed in gear with the sun gear, as shown in FIG. 3. A center portion of the planet carrier 13 has a mounting cylinder 15 projecting inward the bracket 3, which is coupled and secured to the take-up pulley 8 via a coupling cylinder 16, so that the take-up shaft 10 and planet carrier 13 rotate together.

A cylindrical internal gear 17 is formed on its inner periphery with teeth 17*a* which are in gear with the planet gears 14, and a flange portion 18 which is an end portion of the gear 17 adjacent to the driving pulley 11 is formed on its outer periphery with external teeth 19.

Figure 6:
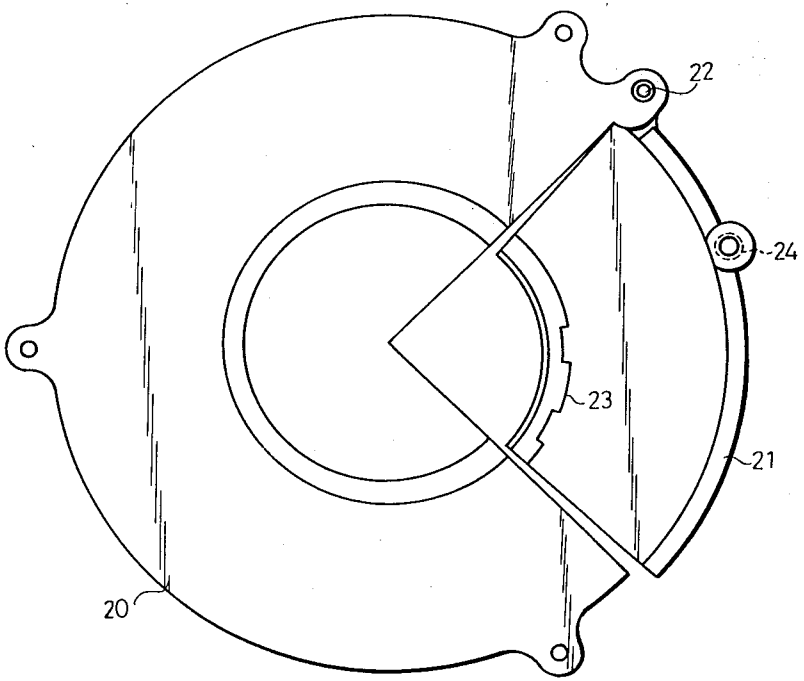
FIG. 6 is a rear view of a control case and a pulley stopper.

The driving pulley 11 and flange portion 18 of the internal gear 17 are covered by a control case 20 and a pulley stopper 21 shown in FIG. 6. The control case 20 is secured to the bracket 3. The pulley stopper 21 corresponds to a quarter part of the control case 20, is supported at the upper end by a shaft 22 pivotably with respect to the control case 20 and normally urged by a spring (not shown) up to a position spaced from the control case 20.

A center portion of the control case 20 projects a little to cover the flange portion 18 of the internal gear 17. The inner periphery of the projection portion of the pulley stopper 21 is formed with internal teeth 23 coming into gear with the external teeth 19 of the flange portion 18. Because the control case 20 and pulley stopper 21 are normally separated from each other by the urging force of the spring, the external teeth 19 of the flange portion 18 are not in gear with the internal teeth 23 of the pulley stopper 21. On the periphery of the pulley stopper 21 a roller 24 is rotatably supported for supporting the control cord 6.

The control cord 6 is coiled around the driving pulley 11 and fixed thereto at the upper end, led outward from the driving pulley 11 through the roller 24 of the pulley stopper 21, after passing through a guide roller 25 provided in an inner lower portion of the bracket 3 and a stopper 26 provided on the bottom face of the bracket 3, and is hanging down below the bracket 3. If the control cord 6 hanging down from the bracket 3 is pulled downward, the pulley stopper 21 is pushed against the control case 20 in opposition to the urging force of the spring by means of the control cord 6 tightened between the guide roller 25 and the driving pulley 11. In response to the above, the internal teeth 23 come into gear with the external teeth 19 of the internal gear 17 and the driving pulley 11 is rotated.

In the above operation, the action of the stopper 26 is automatically released in response to downward pulling of the control cord 6, and movement of the control cord 6 which tends to be wound upward due to a drawing force given from the side of the driving pulley 11 is automatically blocked.

Operation of the shutter 1 of the foregoing structure will now be described.

At the time of closing the shutter 1 being in the full-open state, if the lower margin of the shutter 1 is pulled downward, the take-up shaft 10 is rotated by the weight of the slats 2 thereby to cause the slats 2 to move down. During the above, energy is stored gradually in the take-up spring S accomodated inside the take-up shaft 10. As a result, as shown in FIG. 1, the slats 2 become the mutually-coupled, stretched state. When the lowest one of slats 2 reaches the ground level, the turning torque caused by the weight of each slat 2 and acting on the take-up shaft 10 comes in balance with the turning torque caused by the urging force of the take-up spring S, and this balanced state is preserved.

As is apparent from the above, at the time of moving down the slats, the control cord 6 is not operated and the pulley stopper 21 is in the separated state from the control case 20 due to the urging force of the spring; thus, the internal gear 17 can rotate relatively with respect to the control case 20. Therefore, during the downward movement of the slats 2, the planet gears 14 supported by the planet carrier 13 rotate around the sun gear 12 of the driving pulley 11, while causing the internal gear 17 to rotate, due to revolution of the take-up shaft 10, so that the driving pulley 11 is not rotated.

The shutter 1 unwound up to the state shown in FIG. 1 permits lighting and draft. Following the above, if it is desired to close the slits 5 to get the full-closed state, the control cord 6 is pulled downward. If so operated, the pulley stopper 21 shifts toward the control case 20 and the internal teeth 23 come into gear with the external teeth 19 on the flange portion 18 of the internal gear. At the same time, the driving pulley 11 is rotated. As the pulley stopper 21 comes into gear with the internal gear 17, the latter is prevented from turning. If the driving pulley 11 is rotated in the foregoing state, the planet gears 14 rotate along the inner periphery of the internal gear 17 in response to rotation of the sun gear 12, the planet carrier 13 is rotated in the same direction as the above at a reduced rate, and the take-up shaft 10 is rotated in the direction of causing downward movement of the slats 2. Accordingly, in response to operation of the control cord 6 the torque acting on the driving pulley 11 is strengthened by the planet gears 14 and transmitted to the take-up shaft 10.

Figure 2:
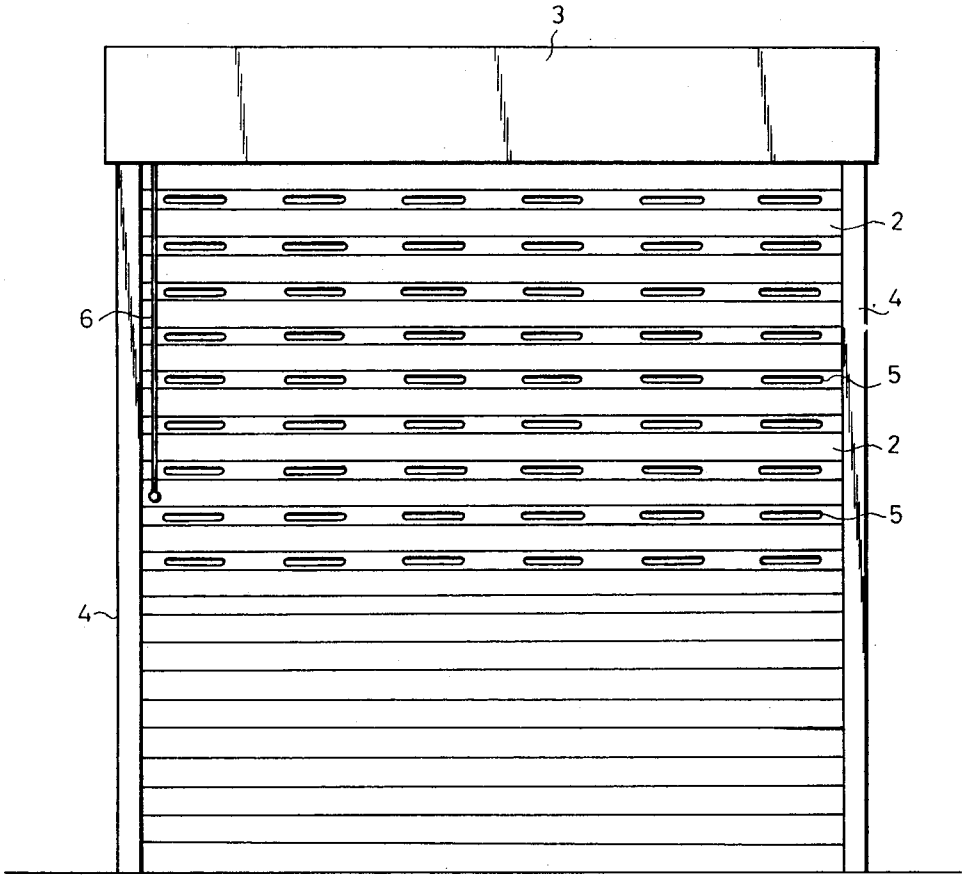
FIG. 2 is a front view showing the half-open state of the slits.

As the take-up shaft 10 rotates in the direction of causing downward movement of the slats 2, the slats 2 change to the contracted state gradually one after another from the lowest one as shown in FIG. 2 to close the slits 5 and, at last, the full-closed state results.

If the control cord 6 is released in the full-closed state or a desired state wherein a desired number of slits 5 are closed from the lowest, although the turning torque is acting on the take-up shaft 10 in the direction of causing winding of the slats 2 due to the urging force of the take-up spring S caused by a slight rotation of the take-up shaft 10 from the balanced state shown in FIG. 1 in the direction of causing downward movement of the slats 2, rotation of the take-up shaft 10 in the same direction as the above is blocked by the stopper 26 operating on the control cord 6. At this moment, the turning torque acting on the take-up shaft 10 is transmitted to the driving pulley 11 after reduced by the planet gears 14; thus, the stopper 26 can be simplified in structure.

At the time of opening the shutter 1 being in the full-closed state, the control cord 6 is pulled downward to remove the action of the stopper 26. Consequently, by the urging force of the take-up spring S the slats 2 are wound up a little and become the state shown in FIG. 1, and the pulley stopper 21 separates from the control case 20, whereby the pulley stopper 21 comes out of gear with the internal gear 17. In this state, if the slats 2 are lifted a little, the turning torque of the take-up shaft 10 caused by the urging force of the take-up spring S exceeds the action of the weight of the slats 2, so that the slats 2 are wound up until the shutter 1 becomes the full-opened state. At this moment, because the internal gear 17 is out of gear with the pulley stopper 21, it can rotate in response to movement of the planet gears 14 rotating around the periphery of the sun gear 12. Therefore, the driving pulley 11 provided with the sun gear 12 is not rotated.

As is apparent from the foregoing description, the open/close operation of the present shutter 1 can be achieved as easily as the conventional shutter does by the use of the urging force of the take-up spring S and the weight of the slats 2. By pulling down the slats 2 being in the full-open state thereby causing the slats 2 to move down by their own weight in opposition to the urging force of the take-up spring S, downward movement of the slats 2 is terminated when the balanced state is reached between the weight of the slats 2 and the urging force of the take-up spring S, with the slits 5 formed in each slat 2 exposed as shown in FIG. 1, whereby lighting and draft are permitted.

Further, through operation of the control cord 6 the slits 5 can be opened and closed arbitrarily.

A second embodiment will now be described with reference to FIGS. 7 through 9. In the following, the same or identical parts of this embodiment to those of the first embodiment bear the same reference numerals as those with the description therefor omitted.

On one end of the core shaft 7 a worm-wheel 31 is supported rotatably via a bearing. From the inner face of the worm-wheel 31 a mounting cylinder 32 projects inward the bracket 3, which is coupled and secured to the take-up pulley 8 via a coupling cylinder 33. Accordingly, the take-up shaft 10 can rotate together with the worm-wheel 31.

Figure 9:
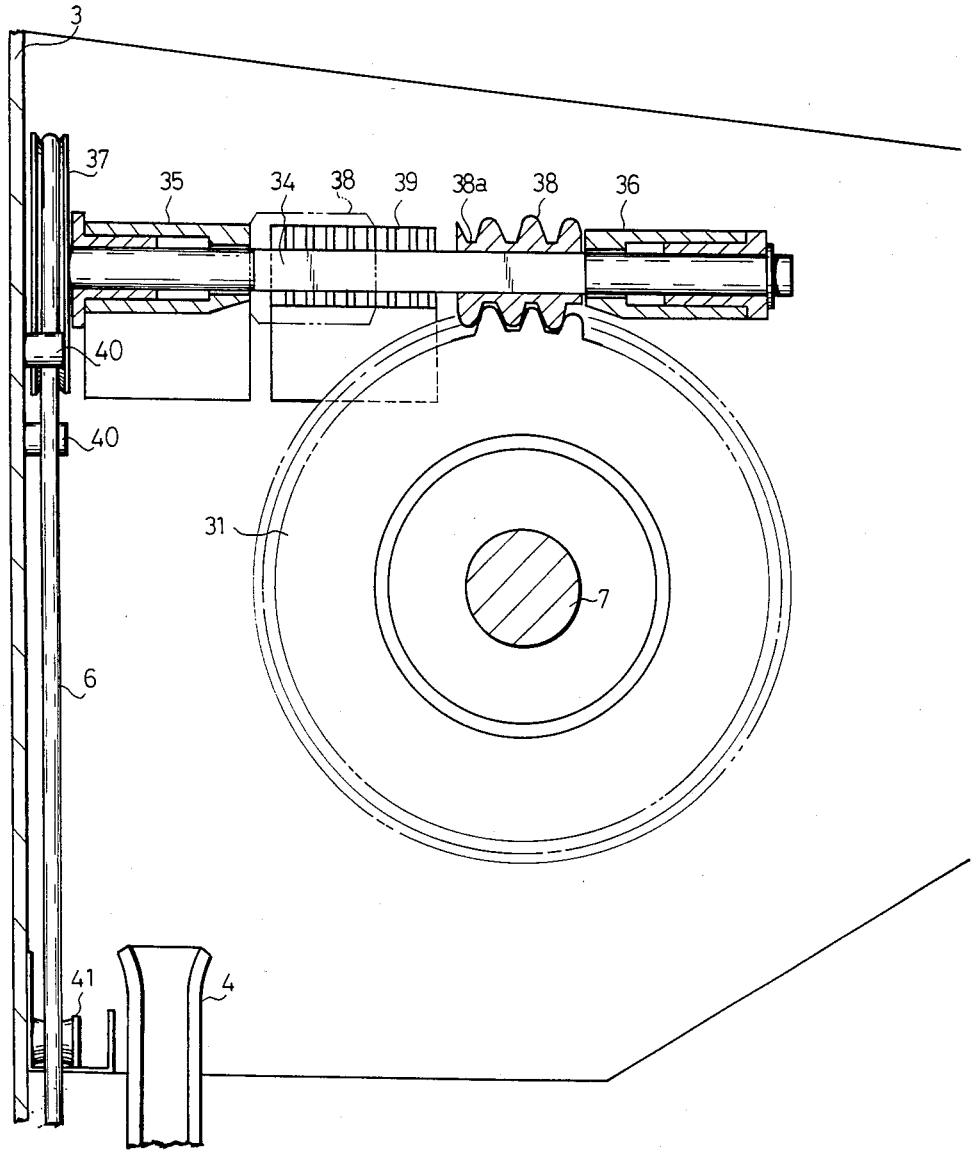
FIG. 9 is a side sectional view of the slit open/close means of the above.

As shown in FIG. 9, above the worm-wheel 31 inside the bracket 3, a control shaft 34 extending in a direction orthogonal to the core shaft 7 is supported rotatably by a bearing 35 and another bearing 36 serving as a gearing maintaining means. On one end of the control shaft 34 which projects beyond the bearing 35 a driving pulley 37 is secured around which the control cord 6 is coiled. Portions of the control shaft 34 corresponding to the bearing 35 and 36 are cylindrical and the remaining portions are made in the form of a quadrangular prism.

Figure 7:
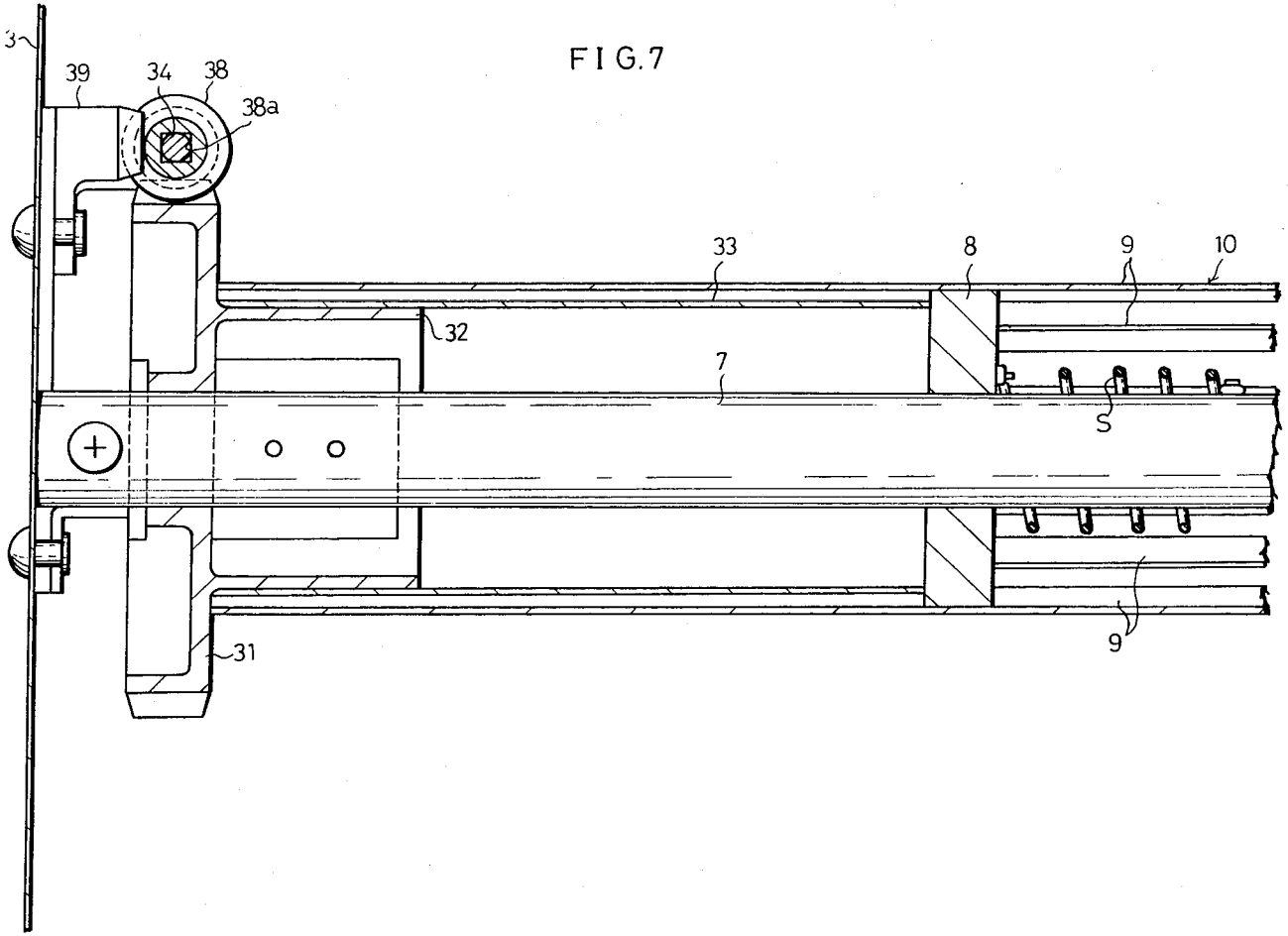
FIG. 7 is a cross sectional view of the slit open/close means of a second embodiment.

As shown in FIG. 7, on one quadrangular prism portion of the control shaft 34 a worm-gear 38 is fitted via its thru-hole 38*a* of quadrangular in section so that they can rotate together. The worm-gear 38 is reciprocatingly slidable laterally (in FIG. 9) from a gearing position with the worm-wheel 31 to a non-gearing position between the bearings 35 and 36. A rack 39 is secured on the bracket 3 such as to be opposite to the non-gearing position (with the worm-wheel 31), or the side of the bearing 35, in the quadrangular prism portion of the control shaft 34. The worm-gear 38 is normally positioned on the side of the bearing 35 and in gear with the rack 39.

Figure 8:
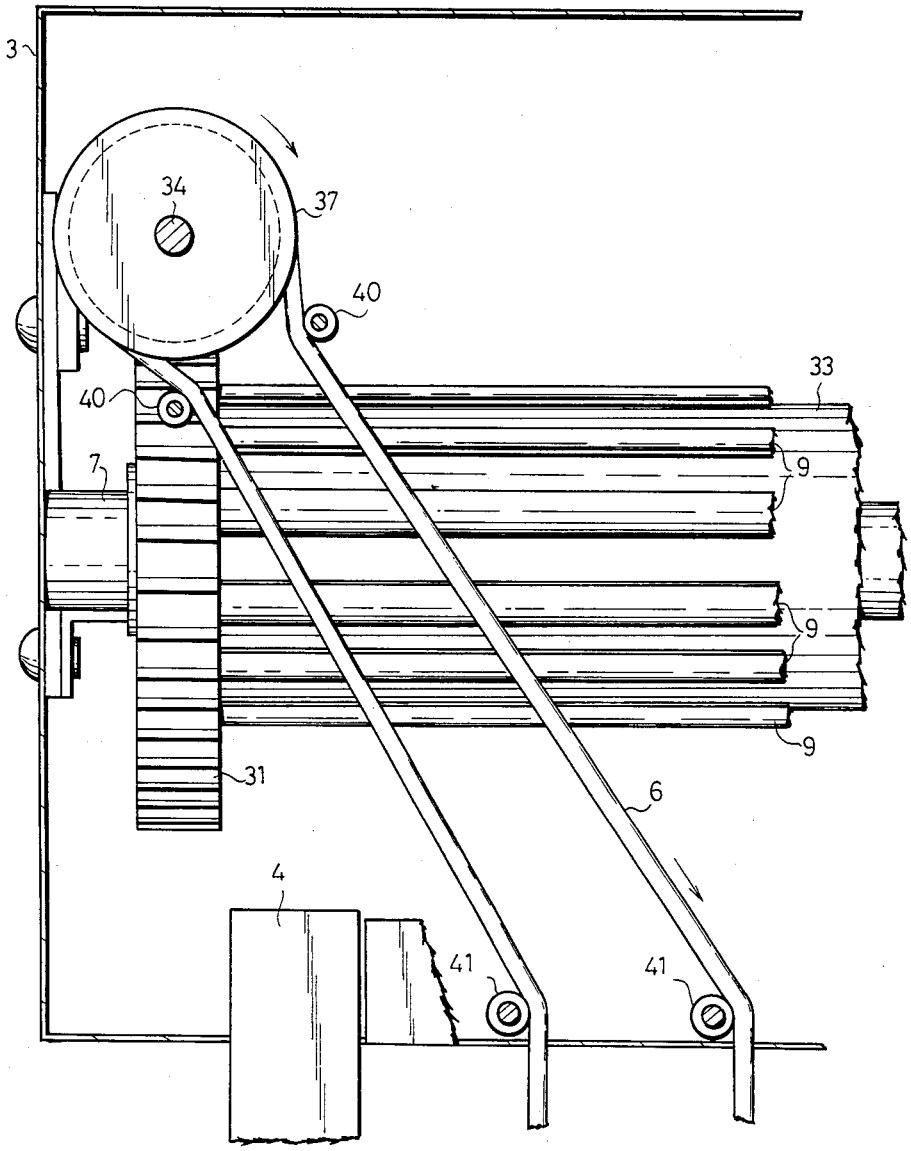
FIG. 8 is a partially enlarged front view of the above.

If the driving pulley 37 is rotated by means of the control cord 6 in the direction of unwinding (i.e. in the direction of the arrow) as shown in FIG. 8, the worm-gear 38 advances through gearing with the rack 39 toward the gearing position and comes into gear with the worm-wheel 31. The worm-gear 38 advances further while gearing with the worm-wheel 31 and comes out of engagement with the rack 39. When the worm-gear 38 abuts on the bearing 36 and is stopped thereby, it is positioned just above the worm-wheel 31.

If the driving pulley 37 is rotated by means of the control cord 6 in the winding direction (i.e. in the direction opposite to the arrow shown in FIG. 8), the worm-gear 38 backs toward the non-gearing position through gearing with the worm-wheel 31 and comes into gear with the rack 39. As the worm-gear 38 moves back further while gearing with the rack 39, it comes out of engagement with the worm-wheel 31, and stops rotation of the driving pulley 37 when it abuts on the bearing 35.

The control shaft 34 and rack 39 form a shifting means.

The control cord 6 is passing through a pair of guide rollers 40 provided on the side face of the bracket 3 and another pair of guide rollers 41 provided at a lower portion of the bracket 3 and hung down.

Operation of the second embodiment of the shutter 1 will now be described.

At the time of closing the shutter 1 being in the full-open state, the lower margin of the shutter 1 is pulled down, similarly to the first embodiment. In response to the above, the take-up shaft 10 is rotated by the weight of each slat 2, whereby the slats 2 move down. During the above, energy is gradually stored in the take-up spring S provided inside the take-up shaft 10. When the lowest one of slats 2 reaches the ground level as shown in FIG. 1 with the slats 2 being mutually coupled in the stretched state due to their own weight, the balanced state is obtained between the turning torque owing to the weight of individual slats 2 acting on the take-up shaft 10 and the turning torque caused by the urging force of the take-up spring S, and this balanced state is preserved.

At the time of moving down the slats as above, the control cord 6 is not operated; thus, the worm-gear 38 of the slit open/close means is positioned at the non-gearing position and spaced from the worm-wheel 31 (as illustrated by the chained line in FIG. 9).

The shutter 1 unwound up to the state shown in FIG. 1 permits lighting and draft through the slits 5. In this state, if the control cord 6 is pulled downward in order to close the slits 5 thereby to get the full-closed state, the driving pulley 37 is rotated in the unwinding direction (i.e. in the direction of the arrow) as shown in FIG. 8. IN response to rotation of the driving pulley 37, the worm-gear 38 is rotated in the same direction together with the control shaft 34 and, because the worm-gear 38 is in gear with the rack 39, it advances and moves toward the worm-wheel 31. As the worm-gear 38 comes into gear with the worm-wheel 31 and advances further in the same direction, the worm-gear 38 comes out of gear with the rack 39. As the worm-gear 38 advances further up to the gearing position and abuts on the bearing 36, the worm-gear 38 comes well into gear with the worm-wheel 31.

When the worm-gear 38 comes in full gear with the worm-wheel 31, the turning torque of the driving pulley 37 is transmitted through the worm-gear 38 to the worm-wheel 31 and in turn to the take-up shaft 10. As the take-up shaft 10 rotates in the direction of causing the slats 2 to move down, the slats 2 change gradually to the contracted state one after another from the lowest one as shown in FIG. 2, whereby the slits 5 are successively closed to result in the full-closed state.

If the control cord 6 is released in the full-closed state or in a partly-closed state wherein a desired number of slits 5 from the lowest are closed, by the urging force of the take-up spring S caused by a slight rotation of the take-up shaft 10 from the balanced state shown in FIG. 1 in the direction of causing the slats 2 to move down the turning torque acts on the take-up shaft 10 in the direction of winding the slats 2; but, such rotation in the above direction is blocked by gearing between the worm-gear 38 and the worm-wheel 31.

At the time of opening the shutter 1 being in the full-closed state, the control cord 6 is pulled in the direction opposite to the above. In response to the above, the driving pulley 37 is rotated in the winding direction (i.e. in the direction opposite to the arrow), the worm-gear 38 backs toward the non-gearing position due to gearing with the worm-wheel 31 as shown in FIG. 9, and comes into gear with the rack 39. As the control cord 6 is pulled further in the same direction as the above, the worm-gear 38 backs while gearing with the rack 39 and comes out of gear with the worm-wheel 31. If the control cord 6 is pulled further, the worm-gear 38 abuts finally on the bearing 35; thus, the worm-gear 38 can rotate no more in this abutted state even if the control cord 6 is pulled further, and the driving pulley 37 does not rotate also.

In the above state, because gearing does not exist between the worm-gear 38 and the worm-wheel 31, if the slats 2 are lifted a little, the turning torque of the take-up shaft 10 caused by the urging force of the take-up spring S exceeds the action of the weight of the slats 2 and the slats 2 are wound up until the shutter 1 becomes the full-open state.

A third embodiment will now be described with reference to FIGS. 10 through 14, particularly, with respect to its different points from the second embodiment.

Figure 12:
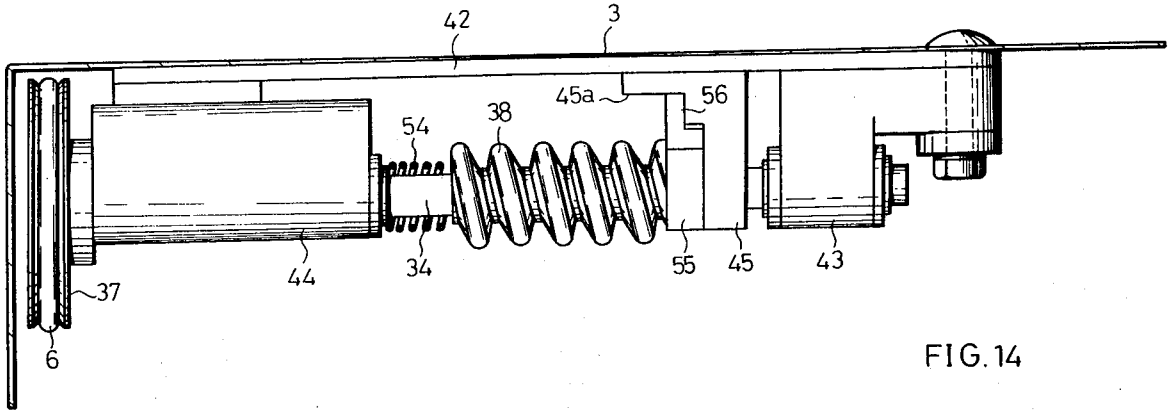
FIG. 12 is a plan sectional view of the slit open/close means of the above.
Figure 13:
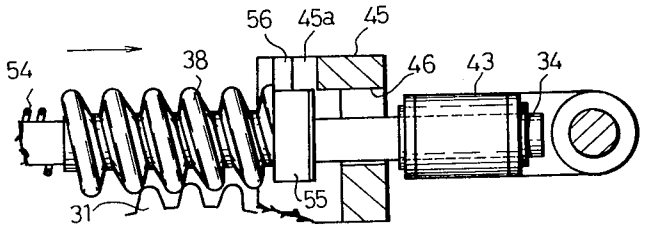
FIG. 13 is a partial sectional view for explanation of operation of the slit open/close means of the above.

In the third embodiment, in place of the bearings 35 and 36 of the second embodiment, a rockable bearing member 43 is mounted vertically swingably via a supporting board 42 on the bracket 3 obliquely above the worm-wheel 31 as shown in FIG. 12, which supports rotatably one end of the control shaft 34. On the other end of the control shaft 34 a movable bearing member 44 is provided independent of the bracket 3.

As shown in FIG. 12, a shaft hold-down member 45 positioned close to the rockable bearing member 43 is mounted via the supporting board 42 on the bracket 3. The shaft hold-down member 45 is formed with a thru-hole 46 through which the control shaft 34 passes vertically swingably.

Figure 14:
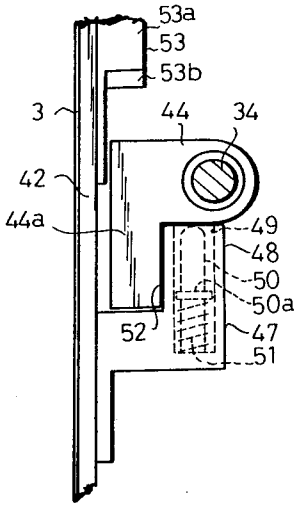
FIG. 14 is a side sectional view of a bearing stopper of the above.

On a portion of the bracket 3 corresponding in position to the movable bearing member 44 a bearing stopper 47 is secured via the supporting board 42 as shown in FIG. 14. The bearing stopper 47 has an L-shaped guide projection 48 extending upward which can abut on the lower face of the movable bearing member 44. The upper face of the guide projection 48 is formed with a storage hole 49 having a bottom.

Figure 10:
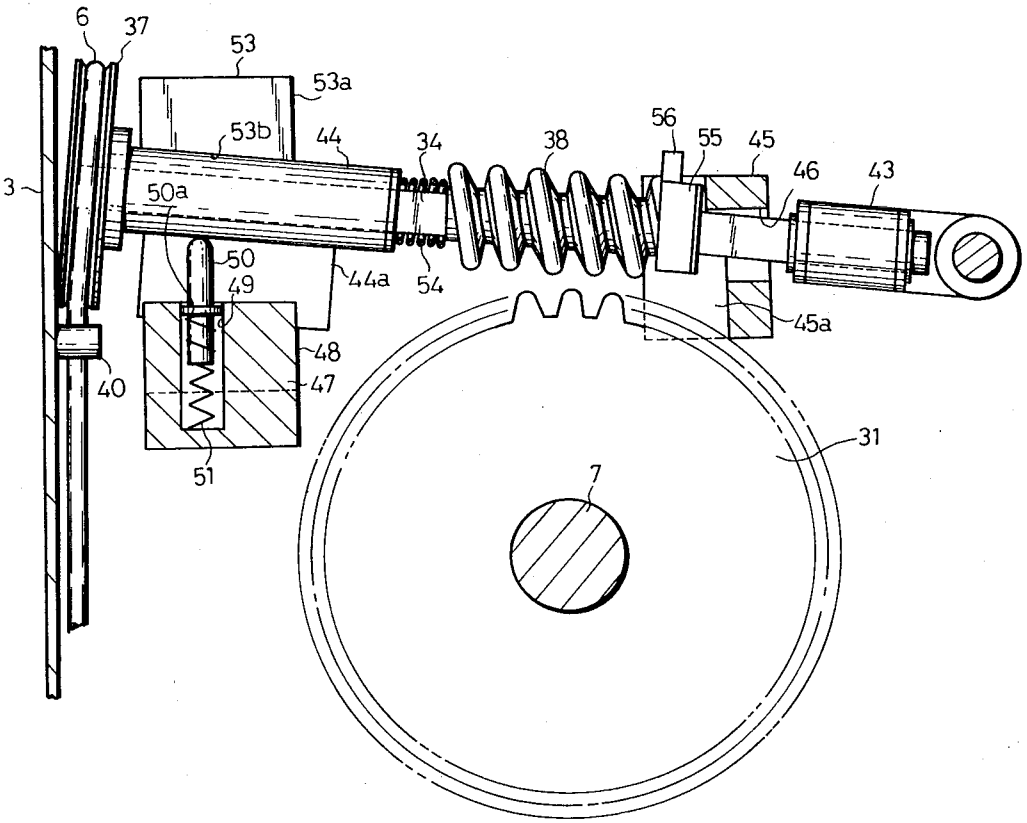
FIG. 10 is a side sectional view of the slit open/close means of a third embodiment.
Figure 11:
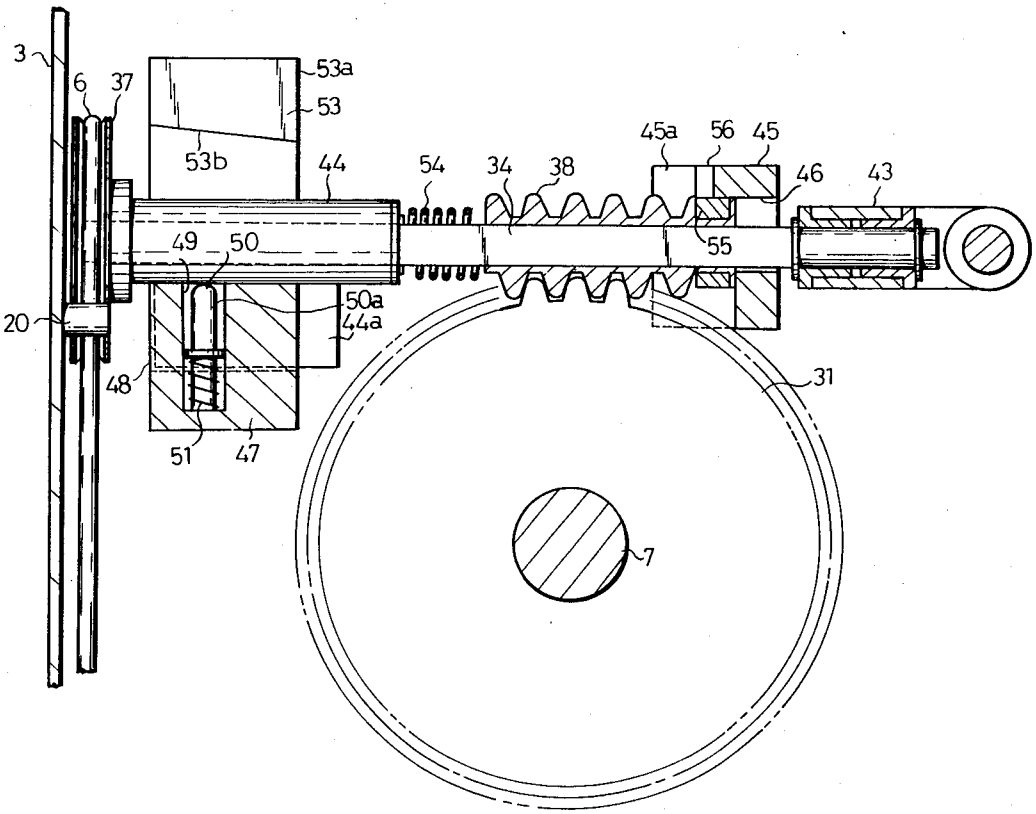
FIG. 11 is a side sectional view showing the state wherein a control shaft has shifted downward from the state shown in FIG. 10.

As shown in FIG. 10, within the storage hole 49 a pushing member 50 is stored vertically movably, and between the pushing member 50 and the storage hole 49 a coil spring 51 serving as an urging means is disposed whole upper end is locked by a lock flange 50*a* of the pushing member 50. The pushing member 50 is normally urged upward by the coil spring 51, and moves up while abutting on the lower face of the movable bearing member 44.

Between the guide projection 48 of the bearing stopper 47 and the supporting board 42 a guide groove 52 is provided in which a projection board 44*a* formed at a lower portion of the movable bearing member 44 fits and is guided thereby.

The rockable bearing member 43, control shaft 34, coil spring 51 and control cord 6 form the shifting means.

Above the bearing stopper 47 a stopper member 53 is secured via the supporting board 42 on the bracket 3. The stopper member 53 has a stepped portion 53*a* in its upper portion and an inclined lock face 53*b* which is the lower surface of the stepped portion 53*a*. This lock face 53*b* blocks via the movable bearing member 44 the control shaft 34 as moved up. That is, the stopper member 53 determines the upper limit position of the control shaft 34.

Around the control shaft 34 a spring 54 is disposed between the worm-gear 38 and the movable bearing member 44 and pinched by these parts 44 and 38 so that it urges the worm-gear 38 toward the rockable bearing member 43. In opposition to the shaft hold-down member 45 a quadrangular lock member 55 is fitted on one end of the worm-gear 38 rotatably, but not detachably. At an upper portion of the lock member 55 a rotation check projection 56 is formed which abuts normally on a side board 45*a* of the shaft hold-down member 45 thereby to be prevented from turning. When the control shaft 34 is moved down and the worm-gear 38 is shifted and arranged such as to come into gear with the worm-wheel 31, the lock member 55 moves toward the shaft hold-down member 45 together with the worm-gear 38 due to the urging force of the spring 54, and abuts on the lower face of the shaft hold-down member 45 to prevent the control shaft 34 from moving up.

In the abutted state as above, a good geared state is obtained between the worm-gear 38 and the worm-wheel 31. Specially, because the worm-wheel 31 can rotate idle a little when the control shaft 34 moves down and the worm-gear 38 is going to come into gear with the worm-wheel 31, the worm-gear 38 can come smoothly into gear with the worm-wheel 31.

The shaft hold-down member 45 and lock member 55 form the gearing/maintaining means.

When the shutter 1 of the foregoing structure is in the state shown in FIG. 1, the control shaft 34 is in the state shown in FIG. 10. That is, due to the urging force of the pushing member 50 the movable bearing member 44 is blocked by the stopper member 53 and the control shaft 34 is blocked by the upper face of the thru-hole 46 of the shaft hold-down member 45. In the above state, if the control cord 6 is pulled down in opposition to the urging force of the coil spring 51 until the lower face of the movable bearing member 44 is blocked by the bearing stopper 47, the driving pulley 37 is pulled downward.

As a result, the worm-gear 38 provided on the control shaft 34 also moves down. The control shaft 34 moves down, the worm-gear 38 opposes to the worm-wheel 31 as able to gear thereinto, the lock member 55 opposes to the thru-hole 46 of the shaft hold-down member 45, and the lock member 55 moves toward the shaft hold-down member 45 together with the worm-gear 38 due to the urging force of the spring 54. Then, the lock member 55 abuts on the lower face of the shaft hold-down member 45 thereby to prevent the control shaft 34 from moving up and maintains the control shaft 34 at the lower limit position.

When the lock member 55 is fitted in the thru-hole 46 of the shaft hold-down member 45, a good geared state is obtained between the worm-gear 38 and the worm-wheel 31.

If the control cord 6 is pulled in the unwinding direction after the worm-gear 38 and worm-wheel 31 have become a good geared state, similarly to the first and second embodiments, the slats 2 change gradually to the contracted state one after another to close the slits 5 and the full-closed state results finally.

Contrarily, at the time of opening the shutter 1 being in the full-closed state, the control cord 6 is pulled in the direction opposite to the foregoing. In response to the above, the driving pulley 37 turns in the winding direction (i.e. in the direction opposite to the arrow), the worm-gear 38 backs toward the movable bearing member 44 due to gearing with the worm-wheel 31 in opposition to the urging force of the spring 54, and correspondingly the lock member 55 is released from the engaged state with the thru-hole 46 of the shaft hold-down member 45.

In the foregoing state, if the operating force on the control cord 6 is removed, the movable bearing member 44 and control shaft 34 move up via the pushing member 50 due to the urging force of the coil spring 51. The movable bearing member 44 and control shaft 34 thus moved up abut on the stopper member 53 and the upper face of the thru-hole 46 of the shaft hold-down member 45, respectively.

In the foregoing state, if the slats 2 are lifted a little, the slats 2 are wound up until the shutter 1 becomes the full-open state.

Since it is apparent that various changes and modifications may be made without departing from the scope and spirit of the present invention, it is to be understood that the invention should not be limited to the precise embodiments described above, but only to the concepts delineated in the following claims.

What is claimed is:

1. A shutter comprising:

a plurality of slats extending laterally and vertically expandably coupled together, each slat including a main portion and an expandable portion having slits therein;

a take-up shaft device including an immovable core shaft, a rotary member rotatably mounted on said core shaft, one of said slats being attached to said rotary member for winding the slats onto and unwinding the slats from the rotary member, and a spring connected between the core shaft and the rotary member for turning the rotary member to wind the slats thereonto; and slit open-close means for expanding and contracting said slats to open and close the slits, said slit open-close means including a worm-wheel mounted on said core shaft to rotate together with said rotary member, a worm-gear situated adjacent to the worm-wheel so that the worm-gear can engage with and disengage from the worm-wheel, and shifting means connected to the worm-gear for shifting the worm-gear to engage with and disengage from the worm-wheel and moving the slats to completely close the slits by rotating the rotary member.

2. A shutter according to claim 1, wherein said shifting means comprises;

a control shaft rotationally situated above and orthogonally to said worm-wheel, said worm-gear being placed on said control shaft so that the worm-gear can rotate together with the control shaft and slide along a longitudinal direction of the control shaft between a gearing position engaging the worm-wheel and a non-gearing position disengaging the worm-wheel, and a rack situated adjacent to the control shaft, said rack, when the worm-gear is in the non-gearing position, engaging the worm-gear so that worm-gear is advanced to the gearing position by rotation of the control shaft.

3. A shutter according to claim 2, wherein said shifting means further comprises a bearing attached to a forward end of the control shaft, said bearing preventing the worm-gear from moving outwardly beyond the gearing position.

4. A shutter according to claim 1, wherein said shifting means comprises;

a rockable bearing member situated above the worm-wheel, said rockable bearing member being vertically swingable relative to the worm-wheel, a control shaft rotationally supported by said rockable bearing member and being disposed orthogonally to said worm-wheel, said worm-gear being placed on said control shaft so that the worm-gear can rotate together with the control shaft and slide along a longitudinal direction of the control shaft, urging means situated under the control shaft for urging said control shaft to an upper position to disengage the worm-gear from the worm-wheel, and a control device connected to the control shaft, said control device, when actuated, operating to engage the worm-gear with the worm-wheel and to turn the worm-wheel by means of the control shaft.

5. A shutter according to claim 4, wherein said shifting means further comprises a shaft hold-down member situated adjacent to the control shaft so that the control shaft is maintained at a low position when said worm-gear is at a gearing position.

6. A shutter comprising:

a plurality of slats extending laterally and vertically expandably coupled together, each slat including a main portion and an expandable portion having slits therein;

a take-up shaft device including an immovable core shaft, a rotary member rotatably mounted on said core shaft, one of said slats being attached to said rotary member for winding the slats onto and unwinding the slats from the rotary member, and a spring connected between the core shaft and the rotary member for turning the rotary member to wind the slats thereonto; and slit open-close means for expanding and contracting said slats to open and close the slits, said slit open-close means including a worm-wheel connected to the rotary member on the core shaft, and an operating device for operating the worm-wheel so that when the operating device is actuated after the shutter is closed at a slit open position, the rotary member is rotated to withdraw the slats downwardly to thereby close the slits, said operating device including a worm-gear situated adjacent to the worm-wheel so that the worm-gear can engage with and disengage from the worm-wheel, and shifting means connected to the worm-gear for shifting the worm-gear to engage with and disengage from the worm-wheel and actuating the slats to completely close the slits by rotating the rotary member.

7. A shutter according to claim 6, wherein said shifting means comprises;

a control shaft rotationally situated above and orthogonally to said worm-wheel, said worm-gear being placed on said control shaft so that the worm-gear can rotate together with the control shaft and slide along a longitudinal direction of the control shaft between a gearing position engaging the worm-wheel and a non-gearing position disengaging the worm-wheel, and a rack situated adjacent to the control shaft, said rack, when the worm-gear is in the non-gearing position, engaging the worm-gear so that worm-gear is advanced to the gearing position by rotation of the control shaft.

8. A shutter according to claim 7, wherein said shifting means further comprises a bearing attached to a forward end of the control shaft, said bearing preventing the worm-gear from moving outwardly beyond the gearing position.

9. A shutter according to claim 6, wherein said shifting means comprises;

a rockable bearing member situated above the worm-wheel, said rockable bearing member being vertically swingable relative to the worm-wheel, a control shaft rotationally supported by said rockable bearing member and being disposed orthogonally to said worm-wheel, said worm-gear being placed on said control shaft so that the worm-gear can rotate together with the control shaft and slide along a longitudinal direction of the control shaft, urging means situated under the control shaft for urging said control shaft to an upper position to disengage the worm-gear from the worm-wheel, and a control device connected to the control shaft, said control device, when actuated, operating to engage the worm-gear with the worm-wheel and to turn the worm-wheel by means of the control shaft.

10. A shutter according to claim 9, wherein said shifting means further comprises a shaft hold-down member situated adjacent to the control shaft so that the control shaft is maintained at a low position when said worm-gear is at a gearing position.

* * * * *